US006915768B2

(12) United States Patent
Ohsawa

(10) Patent No.: US 6,915,768 B2
(45) Date of Patent: Jul. 12, 2005

(54) VARIABLE OPERATING VALVE APPARATUS FOR AN INTERNAL COMBUSTION ENGINE

(75) Inventor: Hiroshi Ohsawa, Shizuoka (JP)

(73) Assignee: Suzuki Motor Corporation, Shizuoka-Ken (JP)

( * ) Notice: Subject to any disclaimer, the term of this patent is extended or adjusted under 35 U.S.C. 154(b) by 0 days.

(21) Appl. No.: 10/728,822

(22) Filed: Dec. 8, 2003

(65) Prior Publication Data

US 2004/0118370 A1 Jun. 24, 2004

(30) Foreign Application Priority Data

Dec. 24, 2002 (JP) ..... 2002-372285

(51) Int. Cl.[7] ..... F01L 1/34

(52) U.S. Cl. ..... 123/90.16; 123/188.1; 123/198 F

(58) Field of Search ..... 123/90.16, 198 F, 123/90.15, 90.17, 90.18, 445, 188.1

(56) References Cited

U.S. PATENT DOCUMENTS

| | | | | |
|---|---|---|---|---|
| 5,636,613 | A * | 6/1997 | Aoyama et al. | 123/432 |
| 6,708,659 | B2 * | 3/2004 | Katayama | 123/90.31 |
| 6,742,483 | B2 * | 6/2004 | Asakura | 123/90.16 |
| 2003/0062211 | A1 | 4/2003 | Tsuruda | |

FOREIGN PATENT DOCUMENTS

| | | |
|---|---|---|
| JP | 5-18221 | 1/1993 |
| JP | 10-18823 | 1/1998 |
| JP | 2002-147241 | 5/2002 |

OTHER PUBLICATIONS

English Language Abstract of JP 5–18221.

English Language Abstract of JP 10–18823.

English Language Abstract of JP 2002–147241.

* cited by examiner

*Primary Examiner*—Thomas Denion
*Assistant Examiner*—Ching Chang
(74) *Attorney, Agent, or Firm*—Greenblum & Bernstein, P.L.C.

(57) ABSTRACT

A variable operating valve apparatus for an internal combustion engine that provides for improved combustion performance without enlarging the size of the cylinder head in the transverse direction. The variable valve mechanism includes a camshaft axially supported by the cylinder head, three-dimensional cams formed on the camshaft, a rocker shaft actuator able to displace the rocker shaft in the axial direction according to engine operating conditions, and a lift volume setting mechanism that changes the amount of valve lift dependent on the extent of positional change of the rocker shaft in the axial direction. The camshaft is at least axially supported on the intake port side of the cylinder head, a fuel injector (which injects fuel into the intake port) is installed to the part of the intake sidewall at the intake port of the cylinder head, and a concave part is formed into the intake sidewall above the fuel injector extending inward toward the camshaft.

12 Claims, 9 Drawing Sheets

VARIABLE OPERATING VALVE APPARATUS FOR AN INTERNAL COMBUSTION ENGINE

BACKGROUND OF THE INVENTION

1. Field of the Invention

The present invention relates to a variable valve mechanism for an internal combustion engine. More specifically, the present invention relates to a variable valve mechanism that allows a fuel injector to be installed at a location that provides for improved combustion performance, without increasing the width of the engine's cylinder head.

2. Description of Background Information

A variable valve mechanism has been applied to engines used in automotive vehicles as manner of variably controlling the extent and duration of valve lift for a valve that opens and closes an intake port leading to a combustion chamber. Furthermore, a fuel injector is provided to lower undesirable exhaust gas emissions.

The prior art includes a variable valve mechanism, of the type applied to an engine, that includes a camshaft that synchronously rotates with a crankshaft, a solid cam with an axially changing profile formed on the camshaft, an actuator that changes the position of the cam profile in the axial direction in response to engine operating conditions, a swinging rocker arm equipped with components that contact multiple valves, a sub-rocker arm supporting a roller follower that rotatably contacts the solid cam, and a sub-rocker support part that supports the swinging movement of the sub-rocker on the rocker arm (see for example, Japanese Published Patent Application H5-18221, pages 3–4 and FIG. 1).

Japanese Published Patent Application H10-18823 (see pages 3–4 and FIG. 1) discloses another type of variable valve mechanism that includes a solid cam camshaft that incorporates a variable low to high-speed profile that changes continuously along the axial direction, an actuator that changes the axial position of the camshaft in relation to engine operating conditions, and an arm that moves in synchronization with two or more adjacent valves and whose movement is dependent on the profile of the solid cam. The aforesaid arm incorporates a follower mechanism that follows positional changes in the linear contact angle of the rotating solid cam through a follower in contact therewith, and two or more contact members that press against the ends of two or more valves.

Japanese Published Application 2002-147241 (see pages 3–4 and FIG. 4) discloses another type of engine in which there is a positional relationship between a fuel injector and a cylinder head.

Currently known variable valve mechanisms of the type applied to internal combustion engines, such as those noted in Japanese Published Patent Application H5-18221 and Japanese Published Patent Application H10-18823, describe a mechanism that includes a camshaft onto which a three-dimensional cam (hereafter referred to as a 3D cam) is formed having a profile that varies along the axial direction, and valves that open and close according to the rotation of the 3D cam, wherein the amount of valve lift varies depending on the positional relationship between the 3D cam and valve stem. These variable valve mechanisms described by Japanese Published Patent Application H5-18221 and Japanese Published Patent Application H10-18823 employ a mechanism in which the valve is driven by the rotational movement of the 3D cam being transferred to the valve through a rocker arm.

Moreover, some internal combustion engines place the fuel injector as close to the combustion chamber as possible in an effort to lower exhaust gas emissions and improve combustion performance. For example, the fuel injector shown in Japanese Published Application 2002-147241 is located in the middle at the top of the cylinder in order to inject fuel directly into the combustion chamber.

These known variable valve mechanisms exhibit an undesirable characteristic in that the use of 3D cams to open and close valves through rocker arms has the effect of increasing the width (the transverse direction at a right angle to the axial centerline of the camshaft) of the cylinder head. Furthermore, increasing the width of the cylinder head makes it more difficult to locate the injector (which sprays fuel into the intake port leading to the combustion chamber) close to the combustion chamber.

In order to solve the shortcomings of the prior art, the present invention proposes a variable valve mechanism that axially supports the camshaft, on which a 3D cam is formed, at least on the intake port side of the cylinder head, locates the fuel injector in the part of the intake sidewall bordering the intake port of the cylinder head, and provides for a concave part, formed in the intake sidewall, that extends inward toward the intake camshaft at a location above the fuel injector. This structure prevents the sidewall from obstructing the installation of the fuel injector to the cylinder head, and allows the fuel injector to be located in closer proximity to the combustion chamber.

SUMMARY OF THE INVENTION

Accordingly, one aspect of the present invention is to provide a variable valve mechanism. The variable valve mechanism includes a camshaft, which is axially supported by an engine cylinder head, onto which a three-dimensional cam is formed to a profile that changes along the axial direction. The camshaft is axially supported at least on an intake port side of the cylinder head. The variable valve mechanism also includes a rocker shaft actuator that changes an axial position of a rocker shaft in response to engine operating conditions, a valve lift volume setting mechanism configured to alter an amount of lift of a valve dependent on the extent of axial movement of the rocker shaft, a fuel injector installed on a part of an intake sidewall bordering the intake port of the cylinder head, in which the fuel injector is configured to spray fuel into an intake port, and a concave part formed in the intake sidewall and extending inward toward the camshaft at a location above the fuel injector.

The concave part is formed at least on a part of said intake sidewall directly opposite a fuel injector harness connector. The fuel injector is installed at the intake sidewall so as to incline the harness connector in a direction away from a sprocket attached to an axial end of the camshaft. The camshaft is axially supported by the cylinder head so that a maximum lift profile of the three-dimensional cam is oriented toward an end of the camshaft to which the sprocket is attached, in which the profile is the part of the cam that applies a maximum valve lift.

According to another aspect of the present invention, a variable valve mechanism for an internal combustion engine is provided. The variable valve mechanism includes a camshaft, axially supported by an engine cylinder head, in which the camshaft includes a three-dimensional cam having a profile that varies along a length of the cam. The variable valve mechanism also includes a rocker shaft having an axial position that changes in response to engine operating conditions, a valve lift volume setting mechanism configured to alter the lift of a valve in response to an amount of axial movement of the rocker shaft, and a fuel injector, configured to spray fuel into an intake port, attached at an intake sidewall, in which the intake sidewall includes a concavity adjacent the fuel injector.

The concavity may include an angular depression extending inward in the direction of the camshaft. Further, the concavity may be formed opposite a connector associated with the fuel injector. Still further, the connector may be angled away from a sprocket on the camshaft. The camshaft may include a maximum lift profile portion that is oriented toward a sprocket end side of the camshaft.

According to another aspect of the present invention, a variable valve mechanism for an internal combustion engine is provided. The variable valve mechanism includes a camshaft, axially supported by an engine cylinder head, in which the camshaft includes a three-dimensional cam having a profile that varies along a length of the cam. The variable valve mechanism also includes a rocker shaft having an axial position that changes in response to engine operating conditions, a valve lift volume setting mechanism configured to alter the lift of a valve in response to an amount of axial movement of the rocker shaft, and a fuel injector, configured to spray fuel into an intake port, attached at an intake sidewall. A connector and a fuel rail, each being associated with the fuel injector are attached to a rearward end of a casing of said fuel injector. As a result, the connector and the fuel rail are not obstructed by the intake side wall.

BRIEF DESCRIPTION OF THE DRAWINGS

The above, and other objects, features and advantages of the present invention will be made apparent from the following description of the preferred embodiments, given as non-limiting examples, with reference to the accompanying drawings, in which.

DETAILED DESCRIPTION OF THE PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, and the description is taken from the drawings making apparent to those skilled in the art how the forms of the present invention may be embodied in practice.

The variable valve mechanism invention described by the present invention specifies a concave part that allows for the non-obstructed installation of a fuel injector into the intake sidewall of a cylinder head without interference therewith, thereby allowing the fuel injector to be located in closer proximity to the combustion chamber.

As a result, the variable valve mechanism allows the fuel injector to be placed at a location beneficial to combustion performance, without increasing the width of the cylinder head in the transverse direction, even though the camshaft, onto which three-dimensional cams are formed, is axially supported on the intake port side of the cylinder head.

Figure 1:
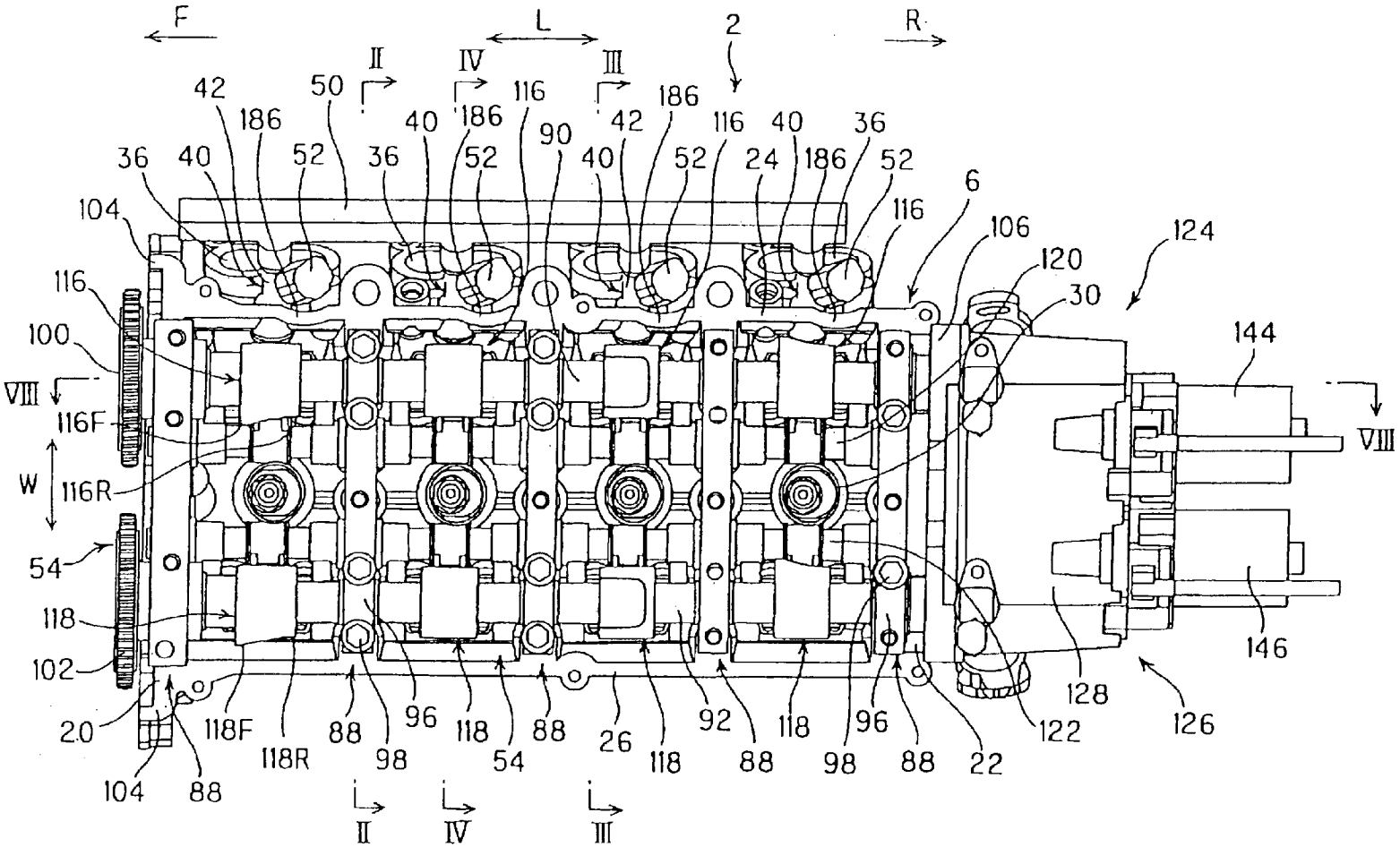
FIG. 1 is a plan view of an engine to which the first embodiment of the variable valve mechanism is equipped, according to an aspect of the present invention.
Figure 2:
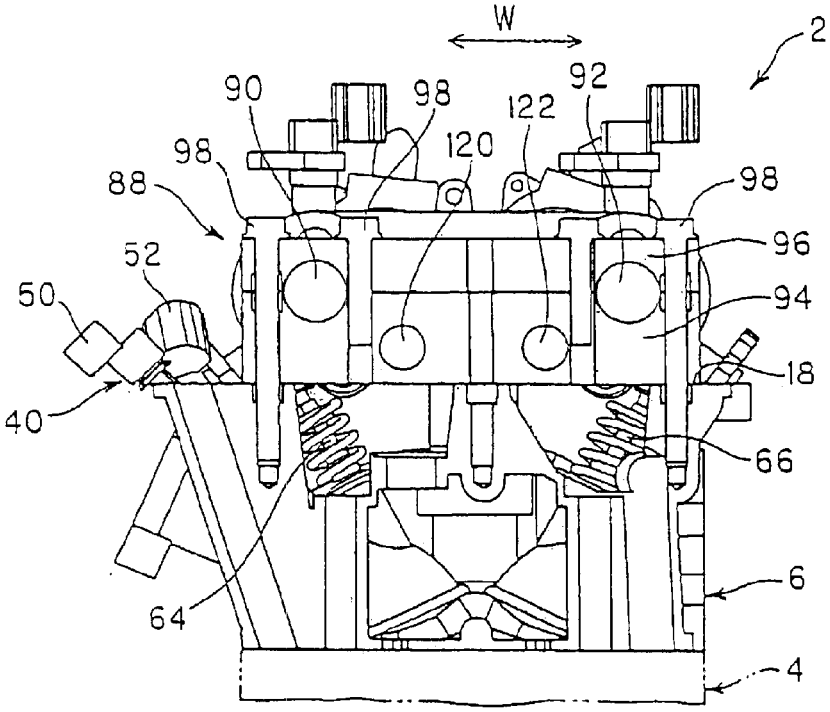
FIG. 2 is a cross section of the engine shown in FIG. 1 as taken from line II—II, according to an aspect of the present invention.
Figure 3:
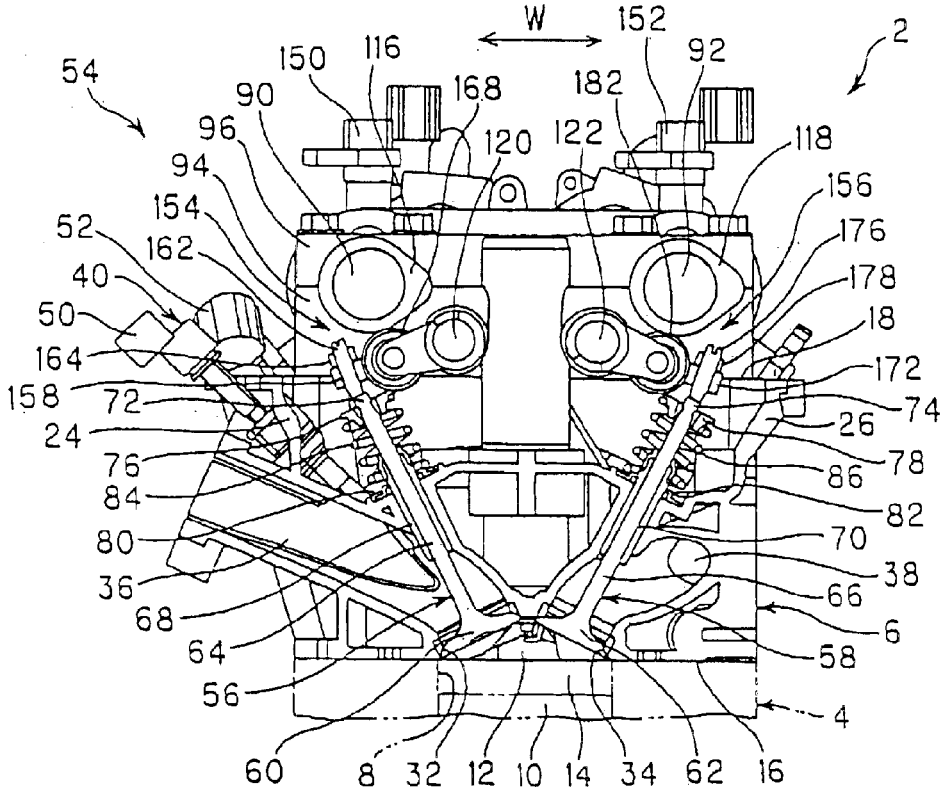
FIG. 3 is a cross section of the engine shown in FIG. 1 as taken from line III—III, according to an aspect of the present invention.

FIGS. 1 through 8 will now be referred to with respect to a first embodiment of the present invention. FIG. 3 illustrates an engine 2 which is installed to a vehicle (not shown in the drawing), a cylinder block 4, a cylinder head 6, a cylinder 8, a piston 10, a head chamber 12, and a combustion chamber 14. The engine 2 includes the cylinder head 6 and the cylinder block 4, in which the cylinder head 6 is attached to the cylinder block 4 at a lower head surface 16. A head cover (not shown in the drawing) attaches to an upper surface 18 of the cylinder head 6. The combustion chamber 14 is defined by the cylinder 8 and the piston 10 in the cylinder block 4, and the head chamber 12 in the cylinder head 6.

The engine 2 is a four-cylinder engine in which each of the four cylinders 8 is located in linear alignment with an adjacent cylinder, each cylinder 8 being equipped with two intake and two exhaust valves (four-valve engine).

Figure 4:
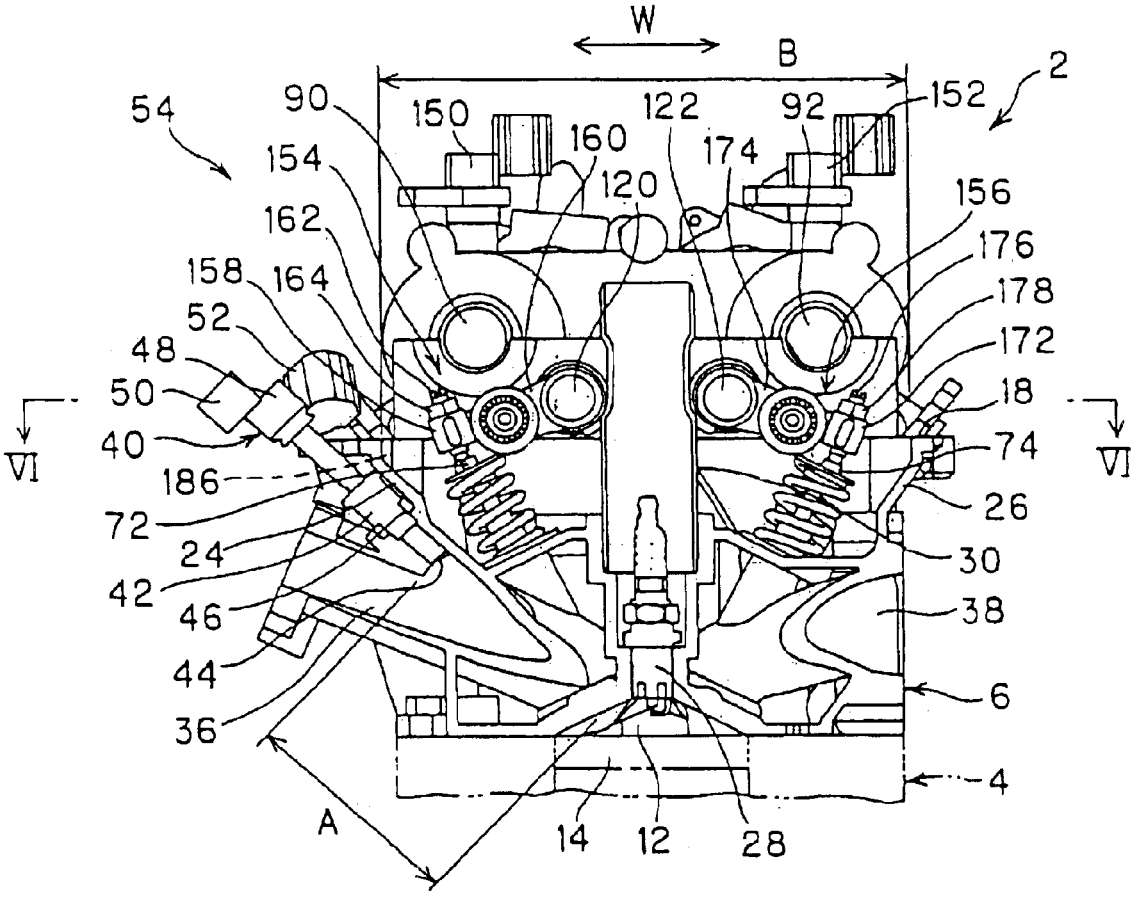
FIG. 4 is a cross section of the engine shown in FIG. 1 as taken from line IV—IV, according to an aspect of the present invention.
Figure 5:
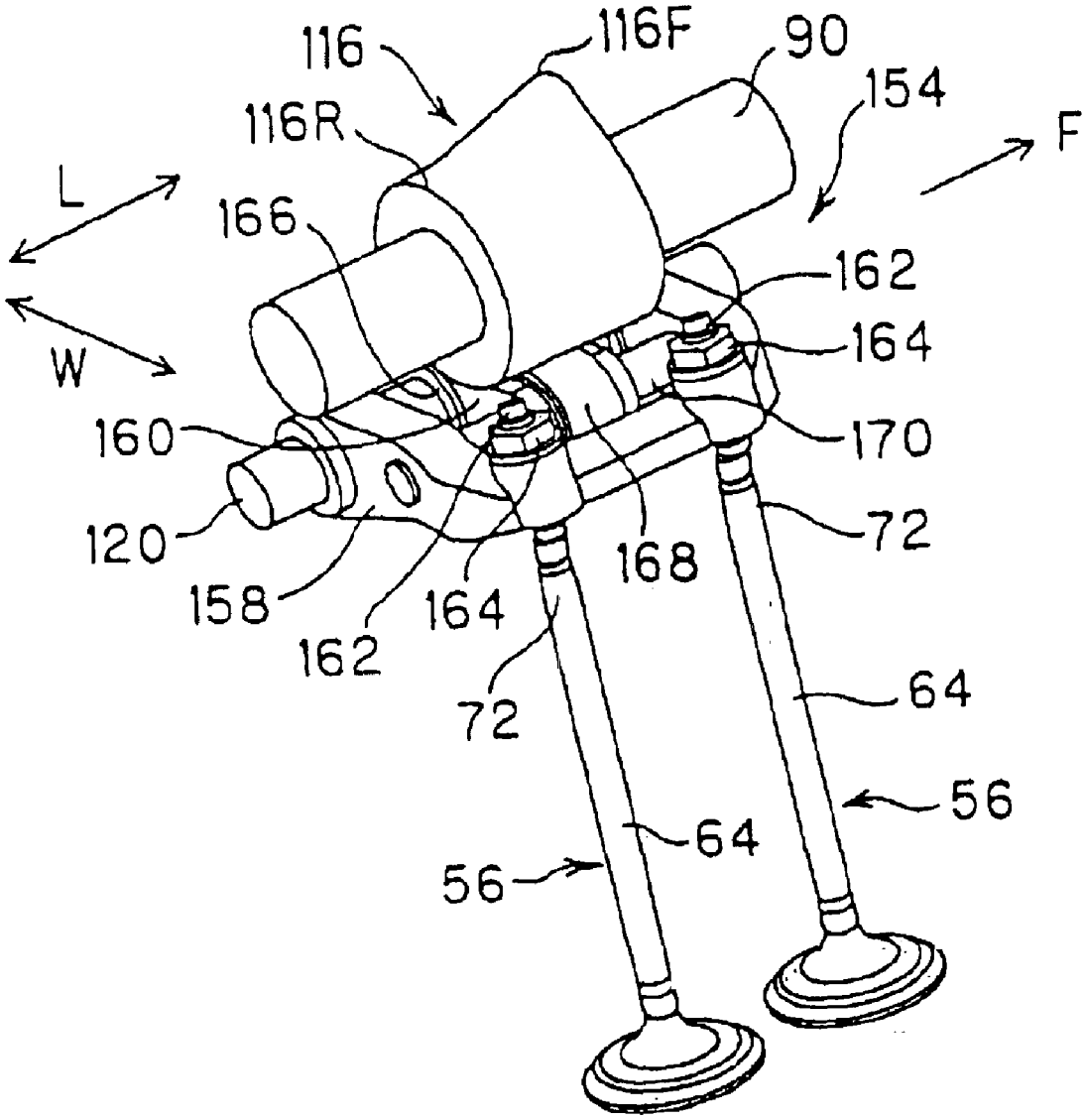
FIG. 5 is an oblique view of an intake valve lift volume setting mechanism, according to an aspect of the present invention.

As shown in the FIG. 1, the cylinder head 6 of the engine 2 is formed to an approximate rectangular shape with the four cylinders 8 being arranged in linear alignment in the lengthwise (L) direction as opposed to the shorter transverse (W) direction. A front wall 20 and a rear wall 22 are located at the respective front (F) and rear (R) sides of engine 2 in the lengthwise (L) direction, and an intake sidewall 24 and an exhaust side wall 26 are located on their respective sides of the engine 2 in the transverse (W) direction. As shown in FIG. 4, a spark plug 28 is installed in the center of the cylinder head 6 along the transverse (W) direction facing the head chamber 12. A plug guide tube 30, which is installed over the spark plug 28, rises to a point above the upper head surface 18.

As shown in FIG. 3, intake and exhaust ports 36 and 38, respectively, are formed within the intake sidewall 24 and the exhaust sidewall 26 of the cylinder head 6, and respectively lead to intake and exhaust valve orifices 32 and 34, respectively, which are formed in the head chamber 12 of the combustion chamber 14. A fuel injector 40 is installed at the intake sidewall 24 and sprays fuel into the combustion chamber 14 through the intake port 36. As illustrated in FIG. 4, a nozzle 44 of a fuel injector casing 42 is inclined toward the intake port 36 through its placement within an injector installation orifice 46 formed in the intake sidewall 24. A rearward end 48 of the fuel injector casing 42 connects to a fuel rail 50. A harness connector 52 is attached to the fuel injector casing 42 near the rearward end 48 in proximity to the intake sidewall 24.

The engine 2 is equipped with a variable valve mechanism 54 which includes an intake valve 56 and an exhaust valve 58 that operate to respectively open and close the intake and the exhaust ports 36 and 38, respectively, of the cylinder head 6. Moreover, in this embodiment, the engine 2 is a four-valve engine in which each cylinder 8 is equipped with two intake valves 56 and two exhaust valves 58.

As illustrated in FIG. 3, an intake valve head 60 and an exhaust valve head 62, which are formed on the ends of the intake valve 56 and the exhaust valve 58, respectively, move with a motion that opens and closes the intake and the exhaust valve orifices 32 and 34, respectively. An intake valve stem 64 and an exhaust valve stem 66 are movably supported along their axial direction by an intake valve stem guide 68 and an exhaust valve stem guide 70 of the cylinder head 6.

The intake and exhaust valves 56 and 58 are equipped with intake and exhaust spring retainers 76 and 78, respectively, that are installed to intake valve stem tip 72 of the intake valve stem 64, and exhaust valve stem tip 74 of the exhaust valve stem 66, respectively. An intake valve spring 84 is compressed between the intake retainer 76 and an intake spring seat 80, and an exhaust valve spring 86 is compressed between the exhaust retainer 78 and an exhaust spring seat 82 on the cylinder head 6. The pressure generated by the intake valve spring 84 and the exhaust valve spring 86 is applied in a direction whereby the intake valve 64 seals off the intake port 36, and the exhaust valve 70 seals off the exhaust port 38 from the combustion chamber 14.

Referring to FIGS. 1 and 2, an intake camshaft 90 and an exhaust camshaft 92 are axially supported by multiple camshaft support structures 88 over the upper head surface 18 of the cylinder head 6 in parallel alignment in the lengthwise (L) direction. Each camshaft support structure 88 includes a first camshaft housing 94 which is installed to the upper head surface 18 oriented in the transverse (W) direction and aligned with the other first camshaft housings 94 at opposing sides of each cylinder 8 in the lengthwise direction (L), and a second camshaft housing 96 which is attached to each first camshaft housing 94, thus holding the camshaft 90 and the exhaust camshaft 92 there between. The camshaft support structure 88 is attached to the upper surface 18 of the cylinder head 6 by housing bolts 98.

The camshaft support structures 88, which axially support the intake and exhaust camshafts 90 and 92 between first and second camshaft housings 94 and 96, locate the intake camshaft 90 toward the outward extending side of the intake port 36, and the exhaust camshaft 92 toward the outward extending side of the exhaust port 38 in the transverse direction (W). An intake cam sprocket 100 and an exhaust cam sprocket 102 are respectively attached to the axial ends of the intake camshaft 90 and the exhaust camshaft 92, that extend forward past the front wall 20 of the cylinder head 6 ("F" direction of the engine 2).

The intake cam sprocket 100 and the exhaust cam sprocket 102 are driven by a timing chain (not shown in the drawings) that runs off of a sprocket on the crankshaft, and are covered by a chain case (not shown in the drawings) attached to case mounting flanges 104 which extend outward in the transverse (W) direction from the front wall 20 of the cylinder head 6.

Moreover, a rear housing 106 is formed as an integral part of the first camshaft housing 94 nearest to rear wall 22 of cylinder head 6, and extends rearward (in the "R" direction of the engine 2) from the rear wall 22. An intake cam thrust receiver 108 (see FIG. 8) and an exhaust cam thrust receiver (not shown in the drawings) are installed around the rear extremities of the intake and the exhaust camshafts 90 and 92 that extend rearward from the rear housing 106 (in the "R" direction of the engine 2).

The intake camshaft thrust receiver mechanism 108 and the exhaust cam thrust receiver mechanism include an intake cam support member 114 and an exhaust cam support flange (the latter not shown in the drawings) which are pressed into the rear housing 106 around the respective rearward protruding ends of the intake and exhaust camshafts 90 and 92 (the latter not shown in FIG. 8) which extend outward from the rear housing 106. The intake cam support member 114 and the exhaust cam support flange are respectively located adjacent to an intake cam thrust bearing 112 and an exhaust cam thrust bearing (the latter not shown in the drawings) and the intake cam thrust washer 110 and an exhaust cam thrust washer (the latter not shown in the drawings). The intake cam thrust receiver mechanism 108 and the exhaust cam thrust receiver mechanism are provided to absorb axial thrust pressure from 3D intake and exhaust cams 116 and 118, respectively, (to be described subsequently), and thus prevent the intake and exhaust camshafts 90 and 92 from moving in the axial direction while rotating.

The variable valve mechanism 54 applied to the engine 2 includes camshafts which are axially supported by the cylinder head 6 and onto which 3D cams are formed with profiles that vary in the axial direction. At least one camshaft, onto which 3D cams are formed, is axially supported at the intake port 36 side of the cylinder head 6.

As illustrated in FIG. 1, the intake camshaft 90, which is axially supported on the intake port 36 side, is a single shaft incorporating four integrally formed 3D intake cams 116, one 3D intake cam 116 being located at each cylinder 8. Likewise, the exhaust camshaft 92, which is supported on the exhaust port 38 side, is a single shaft incorporating four integrally formed 3D exhaust cams 118, one 3D exhaust cam 118 being located at each cylinder 8. Each 3D intake cam 116 incorporates an axially varying lift profile that includes a maximum lift profile 116F and a minimum lift profile 116R, which are able to respectively actuate the intake valve 56 to a maximum and minimum lift volume respectively. Likewise, each 3D exhaust cam 118 incorporates an axially varying lift profile that includes a maximum lift profile 118F and a minimum lift profile 118R which actuate the exhaust valve 58 to a maximum and minimum lift volume, respectively.

Figure 6:
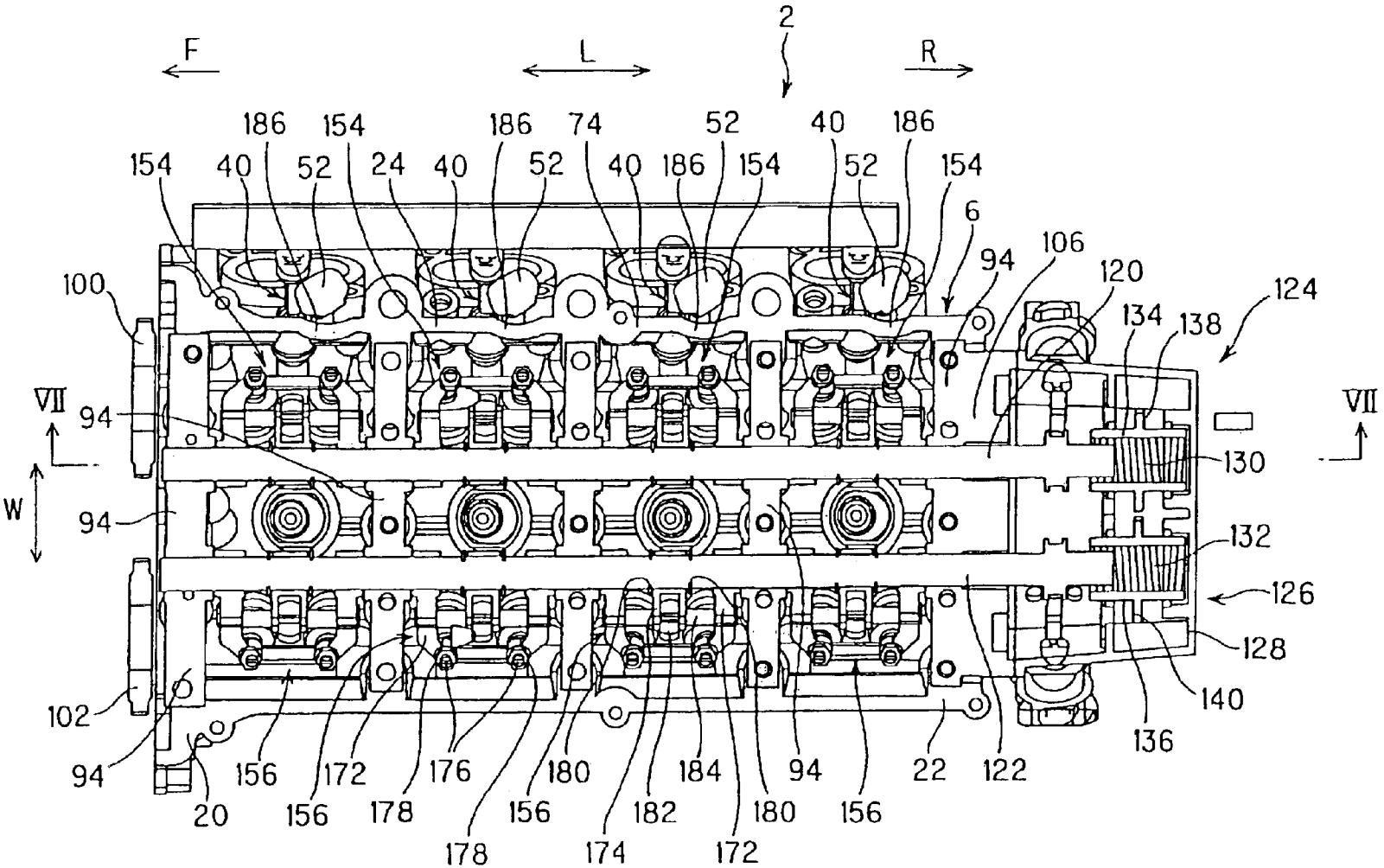
FIG. 6 is a cross section taken from line VI—VI of the FIG. 4, according to an aspect of the present invention.
Figure 7:
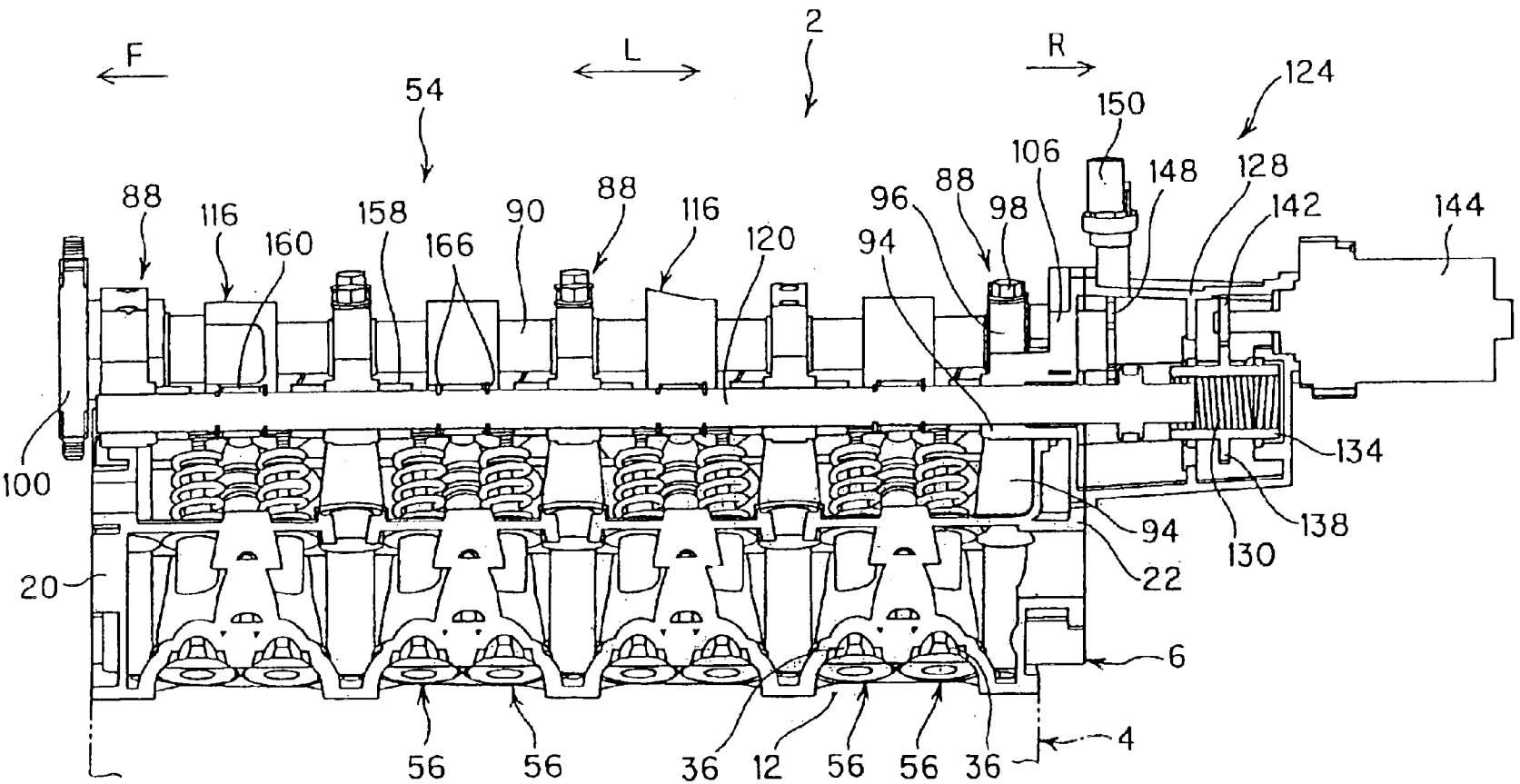
FIG. 7 is a cross section taken from line VII—VII of the FIG. 6, according to an aspect of the present invention.

The first camshaft housing 94 of the camshaft support structure 88 locates the intake camshaft 90 and the exhaust camshaft 92 in parallel alignment along opposing sides of the spark plug guide tubes 30 which are aligned along the center line of the cylinder head 6. An intake rocker shaft 120 and an exhaust rocker shaft 122 are movably supported in the axial direction, and fixedly supported in the radial direction. As can be seen in FIGS. 6 and 7, intake and exhaust rocker shaft actuators 124 and 126 are installed to the end of the rear housing 106 (direction "R") that extends rearward from the first camshaft housing 94 installed to the rear wall 22 of the cylinder head 6. The actuators 124 and 126 operate in response to engine conditions in order to set the axial positions of the intake and exhaust rocker shafts 120 and 122, respectively.

Figure 8:
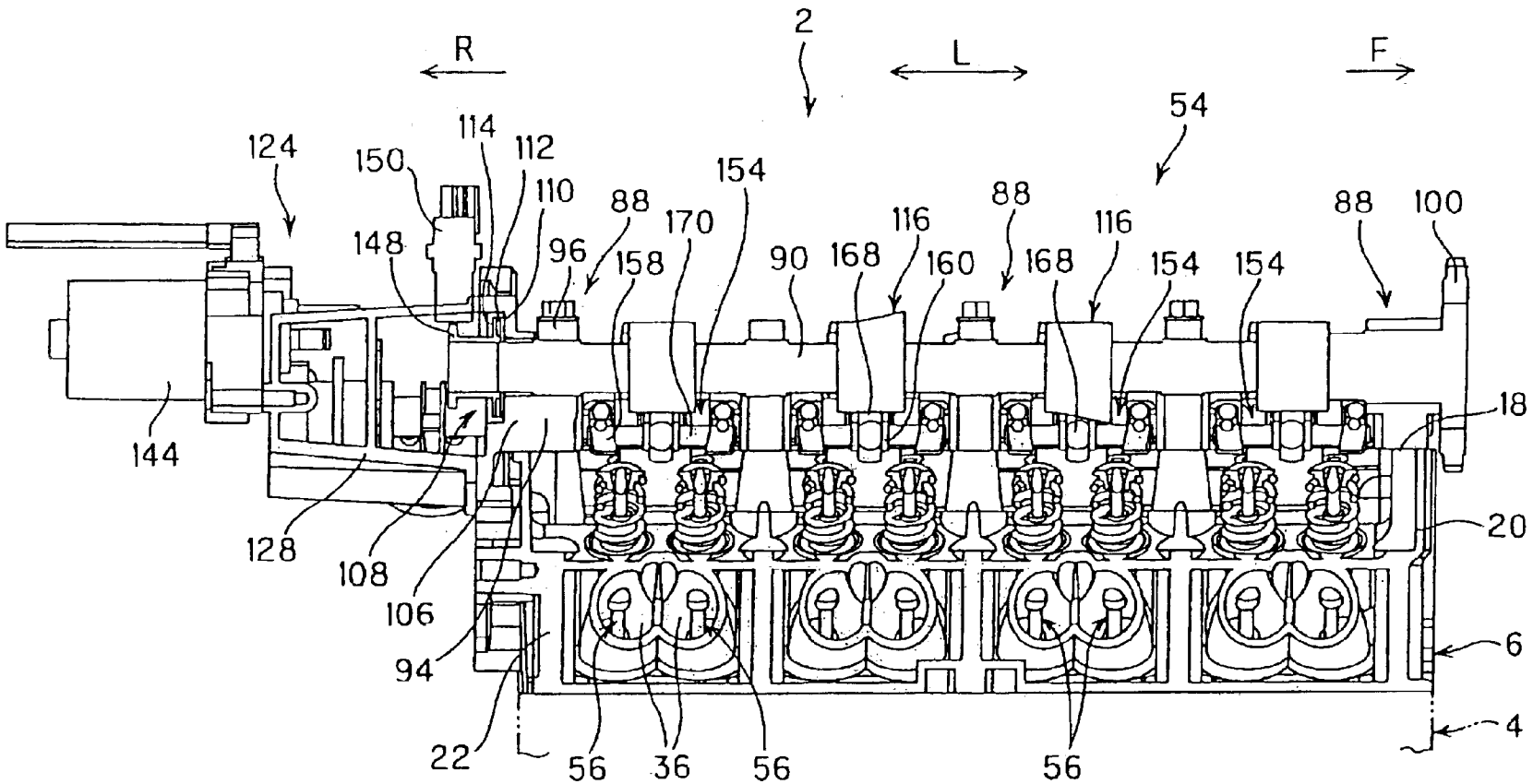
FIG. 8 is a cross section taken from line VIII—VIII of the engine shown in FIG. 1, according to an aspect of the present invention.

As shown in FIGS. 6 through 8, the intake and exhaust rocker shaft actuators 124 and 126 include a motor case 128 installed to the rear housing 106, intake and exhaust rocker shaft male gear members 130 and 132, respectively, which are integrally formed as male threads around the respective ends of the intake and exhaust rocker shafts 120 and 122, and which extend into the motor case 128. The intake and exhaust rocker shaft actuators 124 and 126 also include intake and exhaust rocker shaft female gear members 134 and 136, respectively, which are formed as internally (female) threaded sleeves, movably supported by the motor case 128 in the radial direction but fixedly supported in the axial direction, whose female threads mesh with the male threads of the intake and exhaust rocker shaft male gear members 130 and 132, respectively. The intake and exhaust rocker shaft actuators 124 and 126 further include intake and exhaust rocker shaft relay gears 138 and 140, respectively, that radially extend from the circumference of the intake and exhaust rocker shaft female gear members 134 and 136, respectively.

Further, the intake and exhaust rocker shaft actuators 124 and 126 include intake pinion gear 142 and an exhaust pinion gear (not shown in the drawings) that mesh with the intake and exhaust rocker shaft relay gears 138 and 140, respectively, and include intake and exhaust (FIG. 1) rocker shaft actuator motors 144 and 146, respectively, which are installed to the motor case 128 and which drive the intake pinion gear 142 and the exhaust pinion gear, respectively.

The intake and exhaust rocker shaft actuators 124 and 126 provide a mechanism through which the intake and exhaust rocker shaft motors 144 and 146 are able to rotatably drive the intake and exhaust rocker shaft female gear members 134 and 136 through the intake pinion gear 142 and the exhaust pinion gear respectively driving intake and the exhaust rocker shaft relay gears 138 and 140, thus axially displacing an intake rocker shaft 120 and an exhaust rocker shaft 122 through the respective rotational movements applied to the intake and exhaust rocker shaft male gear members 130 and 132.

As shown in FIGS. 7 and 8, in the interior of the motor case 128, an intake cam sensor trigger 148 and an exhaust cam sensor trigger (not shown in the drawings), formed as integral components, are attached to the intake cam support member 114 and the exhaust cam support flange (not shown in the drawings) that attach to the ends of the intake and exhaust camshafts 90 and 92, respectively, extending from the rear housing 106. The intake cam sensor trigger 148 and the exhaust cam sensor trigger respectively activate intake and exhaust cam angle sensors 150 and 152 (FIG. 4), respectively, which are installed to motor case 128, to provide a cam position detection function.

As illustrated in FIGS. 3 through 6, an intake valve lift volume setting mechanism 154, which applies an amount of lift to the intake valves dependent on the axial position of the intake rocker shaft 120, is located between the 3D intake cam 116 on the intake camshaft 90 and the intake valve stem tip 72 on the end of the intake valve 56. In a similar structure, an exhaust valve lift volume setting mechanism 156, which applies an amount of lift to the exhaust valves dependent on the axial position of the exhaust rocker shaft 122, is located between the 3D exhaust cam 118 on the exhaust camshaft 92 and the exhaust valve stem tip 74 on the end of the exhaust valve 58.

The intake valve lift volume setting mechanism 154 includes first intake rocker arm 158 whose fulcrum end is pivotably supported by and axially movable on the intake rocker shaft 120, and whose non-fulcrum end contacts the intake valve stem tip 72. The intake valve lift volume setting mechanism 154 further includes a second intake rocker arm 160 which contacts the first rocker arm 158, and whose fulcrum end is pivotably supported by the intake rocker shaft 120, but is not axially movable thereon.

The first intake rocker arm 158 is an approximately U-shaped member, positioned between adjacent first camshaft housings 94, whose fulcrum end intersects with and is pivotably supported by the intake rocker shaft 120 while allowing the axial movement of the intake rocker shaft 120 therein. Two intake valve adjuster screws 162 are attached to the middle part of the first intake rocker arm 158 that runs parallel with the intake rocker arm shaft 120, contact the intake valve stem tips 72, and are secured by intake valve adjuster nuts 164.

The second intake rocker arm 160 is a linear member located between the fulcrum ends of the U-shaped first intake rocker arm 158 and held in position on the intake rocker shaft 120 by stop flanges 166. The second intake rocker arm 160 is thus able to radially pivot but not axially slide on the intake rocker shaft 120. An intake roller 168, which rides against the 3D intake cam 116, is rotatably supported by and axially movable on the intake roller shaft 170 which is attached to the center of each end of the U-shaped first intake rocker arm 158.

An abbreviated description of the exhaust valve lift volume setting mechanism 156 will be offered, as mechanism 156 is structurally similar to the intake valve lift volume setting mechanism 154. The exhaust valve lift volume setting mechanism 156 is an approximately U-shaped first exhaust rocker arm 172 and a straightly structured second exhaust rocker arm 174. The fulcrum end of the first exhaust rocker arm 172 is pivotably supported by and axially movable on the exhaust rocker shaft 122. The tip (non-fulcrum) end incorporates two exhaust valve adjuster screws 176 and corresponding exhaust valve adjuster nuts 178. The fulcrum end of the second exhaust rocker arm 174 is pivotably supported by the exhaust rocker shaft 122 and is held in a fixed axial position thereon by stop flanges 180. An exhaust roller 182, which is the contacting member to the 3D exhaust cam 118, is axially supported by exhaust roller shaft 184 whose ends are fixedly attached to the second exhaust rocker arm 174.

The intake and exhaust valve lift volume setting mechanisms 154 and 156 provide a manner through which the amount of lift applied to the intake and exhaust valves 56 and 58 can be altered by changing the position where intake and exhaust rollers 168 and 182, respectively, contact the profiles of 3D intake and exhaust cams 116 and 118, respectively. The positions of the intake and exhaust rollers 168 and 182 can be changed by the mechanism through which the intake and exhaust rocker shaft actuators 124 and 126 move the intake and exhaust rocker shafts 120 and 122 in the axial direction.

As shown in FIGS. 1 and 4, the variable valve mechanism 54 of the engine 2 axially supports the intake camshaft 90, onto which the 3D intake cams 116 are formed, at least at the intake port 36 side of the cylinder head 6. The fuel injector 40, which sprays fuel into the intake port 36, is installed to the part of the intake sidewall 24 bordering the intake port 36 of the cylinder head 6. A concave part 186 is formed as a portion of the intake sidewall 24 that indents toward the intake camshaft 90 above the fuel injector 40.

The concave part 186 is formed as an inwardly curved depression in the intake sidewall 24 at least at a location opposite to the harness connector 52 of the fuel injector 40. The fuel injector 40 is installed to the intake sidewall 24 with the harness connector 52 inclined, with respect to the fuel injector casing 42, in a direction away from the intake cam sprocket 100 (i.e. toward the rear (R) of the engine 2) which is attached to the axial end of the intake camshaft 90. The intake camshaft 90 is axially supported by the cylinder head 6 and oriented to place the maximum intake lift profile 116F (which is the part of the 3D intake cam 116 that applies maximum valve lift) toward the front (F) of the engine 2 in respect to the minimum intake lift profile 116R (which may apply zero lift), that is, on the side of the engine 2 nearer to the intake cam sprocket 100 which is attached to the end of the intake camshaft 90.

The following discussion will explain the operation of the invention. The variable valve mechanism 54, which is incorporated into the engine 2, is able to vary the amount of lift applied to the intake and exhaust valves 56 and 58 by virtue of the intake and exhaust valve lift volume setting mechanisms 154 and 156 and the mechanism through which the intake and exhaust rocker shaft actuators 124 and 126 change the position of the intake and exhaust rocker arm shafts 120 and 122 in the axial direction, thus changing the positions of the intake and exhaust roller 168 and 182 on the profiles of the 3D intake and exhaust cam 116 and 118, respectively.

The variable valve mechanism 54 provides for axial support of the intake camshaft 90, onto which the 3D intake cams 116 are formed, at least on the intake port 36 side of the cylinder head 6. The fuel injector 40, which sprays fuel into the intake port 36, is installed to the part of the intake sidewall 24 bordering the intake port 36 of the cylinder head 6. The concave part 186 is formed within the portion of the intake sidewall 24 located above the fuel injector 40 and extends inwardly in a direction toward the intake camshaft 90.

Thus structured, the variable valve mechanism 54 allows the fuel injector 40 to be installed to the intake sidewall 24 without obstruction as a result of the provision of the concave part 186. As shown in FIG. 4, the fuel injector 40 can be located in closer proximity to the combustion chamber 14 in order to shorten distance "A" between the intake orifice 32 of the combustion chamber 14 and the nozzle 44 of the fuel injector 40.

Even though the variable valve mechanism 54 provides for support of the intake camshaft 90 (onto which the 3D intake cams 116 are formed) at the intake port 36 side of the cylinder head 6, this structure allows the fuel injector 40 to be placed at a location beneficial to combustion performance without increasing width "B" of the cylinder head 6.

Moreover, as the variable valve mechanism 54 provides for at least the formation of the concave part 186 in the intake sidewall 24 opposite the harness connector 52 of the fuel injector 40, the part of the intake sidewall 24 above the harness connector 52 and the fuel injector 40 may be formed to a shape that does not adversely affect the combustion performance of the cylinder head 6.

Furthermore, the variable valve mechanism 54 provides for the installation of the fuel injector 40 to the intake sidewall 24 so that the harness connector 52 inclines away from the intake cam sprocket 100 which is installed to the axial end of the intake camshaft 90, and further provides for the axial support of the intake camshaft 90 in the cylinder head 6 so that the maximum lift profile 116F, which is the part of the 3D intake cam 116 that provides the greatest amount of valve lift, is located nearer the intake cam sprocket 100 side of the intake camshaft 90, the sprocket 100 being attached to the end of the intake camshaft 90.

If the fuel injectors 40 were to be installed to the intake sidewall 24 with the harness connectors 52 inclined in a direction toward the intake sprocket 100 (i.e. toward the front of the engine 2), the harness connector 52 on the forward-most fuel injector 40, that is, the harness connector of the fuel injector installed to the part of the intake sidewall 24 nearest to the front wall 20 of the cylinder head 6, would interfere with the case mounting flange 104 which protrudes outward in the transverse (W) direction from the front wall 20. However, because the harness connector 52 is inclined toward the rear (direction "R") of the engine 2, it does not interfere with the case mounting flange 104 nor the part of the intake sidewall 24 located above the harness connector 52 and the fuel injector 40. Furthermore, by providing a gap between the minimum intake lift profile 116R and the intake sidewall 24, it becomes possible to form the concave part 186 in the intake sidewall 24 at a location opposing the harness connector 52 of the fuel injector 40.

Figure 9:
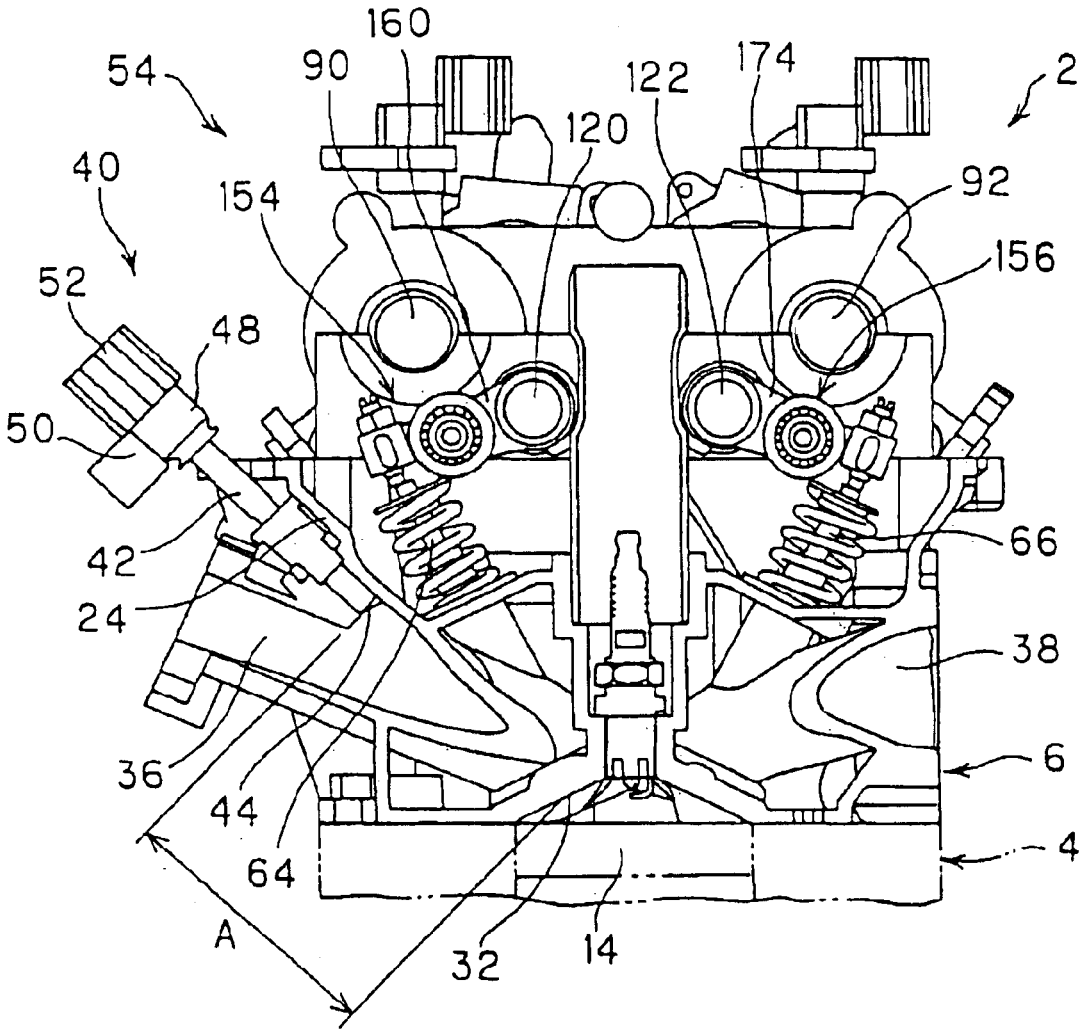
FIG. 9 is a cross section of an engine to which a second embodiment of the variable valve mechanism is installed, according to an aspect of the present invention.

FIG. 9 describes a second embodiment of the invention. In this second embodiment of the variable valve mechanism 54, the fuel injector 40 is installed to the intake sidewall 24 of the cylinder head 6, the harness connector 52 is installed to the rearward end 48 of the fuel injector casing 42 of the fuel injector 40, and the fuel rail 50 is installed to the rearward end 48 of the fuel injector casing 42 opposite to the intake sidewall 24.

In this second embodiment of the variable valve mechanism 54, the harness connector 52 and the fuel rail 50, which are connected to the fuel injector casing 42 of the fuel injector 40, are located farther away from the intake sidewall 24 as compared to their positions in the first embodiment, thus preventing the harness connector 52 and the fuel rail 50 from being obstructed by the intake sidewall 24 of the cylinder head 6, and thus allowing distance "A" (the distance between the nozzle 44 of the fuel injector 40 and the intake orifice 32 of the combustion chamber 14) to be reduced to a length shorter than that of the corresponding distance "A" in the first embodiment. The fuel injector 40 can thus be positioned closer to the combustion chamber 14.

As a result, the second embodiment of the variable valve mechanism 54 makes it possible to install the fuel injector 40 at a location conducive to improved combustion performance without widening width "B" of the cylinder head 6.

Figure 10:
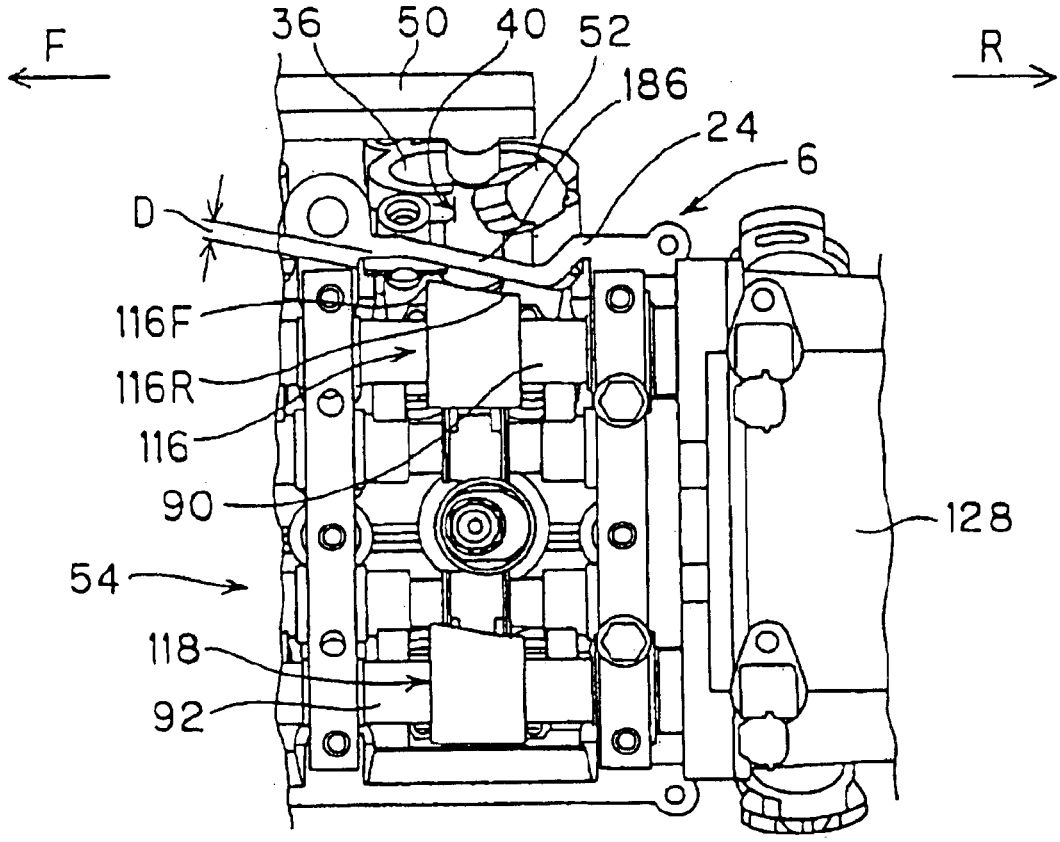
FIG. 10 is a partial plan view of the engine to which a third embodiment of the invention is installed, according to an aspect of the present invention.

FIG. 10 describes a third embodiment of the invention. In this third embodiment of the variable valve mechanism 54, the concave part 186 is formed as an angular depression extending inward toward the intake camshaft 90, in the part of the intake sidewall 24 located above the fuel injector 40, in order to reduce the width of gap "D" that extends along the profile of the 3D intake cam 116 from the maximum intake lift profile 116F to the minimum intake lift profile 116R.

In this third embodiment of the variable valve mechanism 54, the concave part 186 is formed as an inward extending angular contour of the intake sidewall 24 at the fuel injector 40. The concave part 186 reduces the width of gap "D" adjacent to the profile of the 3D intake cam 116, and thus not only makes it possible to locate the fuel injector 40 nearer to the combustion chamber 14, but to provide sufficient space between the intake sidewall 24 and the harness connector 52 of the fuel injector 40.

As a result, the third embodiment of the variable valve mechanism 54 provides for easy installation of the harness connector 52 and allows for the placement of the fuel injector 40 at a location beneficial to combustion performance.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The present disclosure relates to subject matter contained in priority Japanese Application No. 2002-372285, filed on Dec. 24, 2002, which is herein expressly incorporated by reference in its entirety.

What is claimed is:

1. A variable valve mechanism for an internal combustion engine, comprising:

a camshaft, axially supported by an engine cylinder head, onto which a three-dimensional cam is formed to a profile that changes along the axial direction, said camshaft being axially supported at least on an intake port side of said cylinder head;

a rocker shaft actuator configured to change an axial position of a rocker shaft in response to engine operating conditions;

a valve lift volume setting mechanism configured to alter an amount of lift of a valve dependent on the extent of axial movement of said rocker shaft;

a fuel injector installed on a part of an intake sidewall bordering said intake port of said cylinder head, said fuel injector configured to spray fuel into an intake port; and a concave part formed in said intake sidewall and extending inward toward said camshaft at a location above said fuel injector.

2. The variable valve mechanism according to claim 1, wherein said concave part is formed at least on a part of said intake sidewall directly opposite a fuel injector harness connector.

3. The variable valve mechanism according to claim 1, wherein said fuel injector is installed at said intake sidewall so as to incline said harness connector in a direction away from a sprocket attached to an axial end of said camshaft, and wherein said camshaft is axially supported by said cylinder head so that a maximum lift profile of said three-dimensional cain, said profile being the part of said cam that applies a maximum valve lift, is oriented toward an end of said camshaft to which said sprocket is attached.

4. A variable operating valve apparatus for an internal combustion engine, comprising:

a camshaft, axially supported by an engine cylinder head, said camshaft comprising a three-dimensional cam having a profile that varies along a length of said cam;

a rocker shaft having an axial position that changes in response to engine operating conditions;

a valve lift volume setting mechanism configured to alter the lift of a valve in response to an amount of axial movement of said rocker shaft; and a fuel injector attached at an intake sidewall, said fuel injector configured to spray fuel into an intake port, wherein said intake sidewall comprises a concavity adjacent said fuel injector, said concavity formed as an inwardly curved depression in said intake sidewall and being configured to permit said fuel injector to be installed at said intake sidewall.

5. The variable operating valve apparatus according to claim 4, said concavity further comprising an angular depression extending inward in the direction of said camshaft.

6. The variable operating valve apparatus according to claim 4, wherein said concavity is formed opposite a connector associated with said fuel injector.

7. The variable operating valve apparatus according to claim 6, wherein said connector is angled away from a sprocket on said camshaft.

8. The variable operating valve apparatus according to claim 4, said camshaft further comprising a maximum lift profile portion that is oriented toward a sprocket end side of said camshaft.

9. A variable operating valve apparatus for an internal combustion engine, comprising:

a camshaft, axially supported by an engine cylinder head, said camshaft comprising a three-dimensional cam having a profile that varies along a length of said cam;

a rocker shaft having an axial position that changes in response to engine operating conditions;

a valve lift volume setting mechanism configured to alter the lift of a valve in response to an amount of axial movement of said rocker shaft; and a fuel injector attached at an intake sidewall, said fuel injector configured to spray fuel into an intake port;

wherein said intake sidewall comprises a concavity adjacent said fuel injector, said concavity formed as an inwardly curved depression in said intake sidewall and being configured to permit said fuel injector to be installed at said intake sidewall; and a connector and a fuel rail, each being associated with said fuel injector, and each being attached to a rearward end of a casing of said fuel injector.

10. The variable operating valve apparatus according to claim 9, wherein said connector and said fuel rail are unimpeded by said intake sidewall.

11. A variable operating valve apparatus for an internal combustion engine, comprising:

a camshaft, axially supported by an engine cylinder head, said camshaft comprising a three-dimensional cam having a profile that varies along a length of said cam;

a rocker shaft having an axial position that changes in response to engine operating conditions;

a valve lift volume setting mechanism configured to alter the lift of a valve in response to an amount of axial movement of said rocker shaft; and a fuel injector attached at an intake sidewall, said fuel injector configured to spray fuel into an intake port, wherein said intake sidewall comprises a concavity adjacent said fuel injector, said concavity permitting said fuel injector to be installed at said intake sidewall;

said concavity further comprising an angular depression extending inward in the direction of said camshaft.

12. A variable operating valve apparatus for an internal combustion engine, comprising:

a camshaft, axially supported by an engine cylinder head, said camshaft comprising a three-dimensional cam having a profile that varies along a length of said cam;

a rocker shaft having an axial position that changes in response to engine operating conditions;

a valve lift volume setting mechanism configured to alter the lift of a valve in response to an amount of axial movement of said rocker shaft; and a fuel injector attached at an intake sidewall, said fuel injector configured to spray fuel into an intake port, wherein said intake sidewall comprises a concavity adjacent said fuel injector, said concavity permitting said fuel injector to be installed at said intake sidewall;

wherein said concavity is formed opposite a connector associated with said fuel injector; and wherein said connector is angled away from a sprocket on said camshaft.

* * * * *

UNITED STATES PATENT AND TRADEMARK OFFICE

CERTIFICATE OF CORRECTION

PATENT NO. : 6,915,768 B2
DATED : July 12, 2005
INVENTOR(S) : H. Ohsawa

It is certified that error appears in the above-identified patent and that said Letters Patent is hereby corrected as shown below:

Column 11,
Line 55, "cain" should be -- cam --.

Signed and Sealed this

Fourth Day of April, 2006

JON W. DUDAS
*Director of the United States Patent and Trademark Office*